US006230431B1

(12) United States Patent
Bear

(10) Patent No.: US 6,230,431 B1
(45) Date of Patent: May 15, 2001

(54) NIGHT LASER SIGHT

(75) Inventor: Hsiung Bear, Taipei (TW)

(73) Assignee: Limate Corporation, Taipei (TW)

( * ) Notice: Subject to any disclaimer, the term of this patent is extended or adjusted under 35 U.S.C. 154(b) by 0 days.

(21) Appl. No.: 09/348,507

(22) Filed: Jul. 7, 1999

(51) Int. Cl.[7] ..... F41G 1/36
(52) U.S. Cl. ..... 42/103; 362/114; 33/244
(58) Field of Search ..... 42/103; 362/110, 362/113, 114; 33/244

(56) References Cited

U.S. PATENT DOCUMENTS 5,351,429 * 10/1994 Ford ..... 42/103
5,425,299 * 6/1995 Teetzel ..... 89/14.4
5,509,226 * 4/1996 Houde-Walker ..... 42/103
5,581,898 * 12/1996 Thummel ..... 33/241
5,584,137 * 12/1996 Teetzel ..... 42/103

* cited by examiner

*Primary Examiner*—Stephen M. Johnson
(74) *Attorney, Agent, or Firm*—Rosenberger, Klein & Lee

(57) ABSTRACT

A night laser sight comprises a maintube assembly including a first receiving space having a first beam outlet, and a second receiving space having a plurality of second beam outlets being integrated with the first receiving space; a front cover having a third beam outlet securing to a front of the first receiving space; a laser module disposed at a rear of the front cover; a light-emitting diode ("LED") means disposed within the second receiving space; a plurality of batteries disposed at a rear of the laser module for providing an electric current to the laser module and the LED means; a switch means disposed in a rear of the plurality of batteries; and a switching controller disposed in a rear of the second receiving space. When the switch means is turned on, the laser module and the LED means is turned on simultaneously, or the laser module is turned on and the LED means is turned off, thereby emitting a laser beam from the first beam outlet and a pair of laser beams from the second beam outlets respectively.

19 Claims, 3 Drawing Sheets

NIGHT LASER SIGHT

BACKGROUND OF THE INVENTION

1. Field of the Invention

The present invention relates to a sight, and more particularly to a night laser sight equipped with light-emitting diodes ("LEDs") to aid the eyes in lining up a handgun.

2. Description of Related Art

Various designs of laser sight have been located in a search. For example, Taiwanese Patent Publication No. 321,289 discloses an improved laser sight comprising a first maintube having a front-to-back tapered inner diameter including a tube member atop, an internal screw thread having a detent formed on the back end, a threaded hole is provided in the front of the first maintube; a lens assembly threadedly secured to the threaded hole in the front of the first maintube having a first tube atop in which a lens is accommodated within the rear portion of the first tube such that the incident light of the lens can project on the aimed target through the first tube after concentration of the lens; a base provided in the back of the lens having a guide tube atop for accommodating an optical means attached to a circuit board; a second maintube provided in the back of the base having one side threadedly secured to the sight having a wall for dividing the second maintube into a first receiving space and a second receiving space such that a washer, a first spring, and a pad disposed in a space between the first receiving space and the base in the sight, and a battery and a second spring disposed in the second receiving space in which one end of the second spring is biased against the negative electrode of the battery, and the other end of the second spring is attached to the circuit board, the positive electrode of the battery is open to the outside of the second maintube, and an external thread is provided on the circumference of the rear portion of the second maintube; a terminal disposed in the back of the battery having a second tube atop; a striker seat provided in the back of the terminal in which a third spring is provided between the striker seat and the terminal, a third tube atop the striker seat having a front portion threadedly secured to a striker which having a portion open to the outside the striker seat for leaving a small gap with respect to the positive electrode of the battery, a striker spring and a threaded element disposed in the back of the striker; and a back seat threadedly secured to the internal screw thread in the back of the sight having a hole for threadedly securing the terminal therein in which the back end of the striker seat is open to the outside of the back seat.

In use, for example, the sight is mounted on a rifle or pistol. The striker will be in contact with the positive electrode of the battery when the striker seat of the first maintube is struck. As a result, a laser will be emitted from the optical means which in turn projects on an aimed target through concentration of the lens.

However, such laser sight is not suitable for nighttime use due to no built-in lighting equipment provided. Further, the striker is subject to wear after a predetermined period of use. Furthermore, a supporting means is not provided such that it is only suitable for a long barrel rifle or hunting gun mounted within the receiver. As such, it is inconvenient to disassemble. This laser sight is definitely not suitable for handgun.

Another technique to overcome the nighttime lighting problem is implemented in a situation, for example, a police hold a pistol with the right hand with a connected laser sight turned on, while holding a lighted flashlight with the left hand. This implementation is undesirable because two hands are used to hold things and to turn on the laser sight and the flashlight, resulting in a waste of time and not being able to respond quickly.

Still another prior art laser sight such as a night laser sight for handgun is disclosed in Taiwanese Patent Publication No. 320,282 wherein a flashlight is disposed below the handgun for identifying friend-or-foe. However, it is found that the whole device is bulky, resulting in unabling to put it in the enclosure, and to the worse the aiming is poor. It is also required to turn on the laser sight and the flashlight sequentially, i.e., a simultaneous operation is not permitted. Again the response time of this night laser sight in an emergency is not acceptable.

Thus, it is desirable to provide a night laser sight for a handgun to overcome the above drawbacks of prior art.

SUMMARY OF THE INVENTION

It is an target of the present invention to provide a night laser sight equipped with LEDs to aid the eyes in lining up a handgun.

The above and other targets, features and advantages of the present invention will become apparent from the following detailed description taken with the accompanying drawings.

DETAILED DESCRIPTION OF THE PREFERRED EMBODIMENTS

Figure 1:
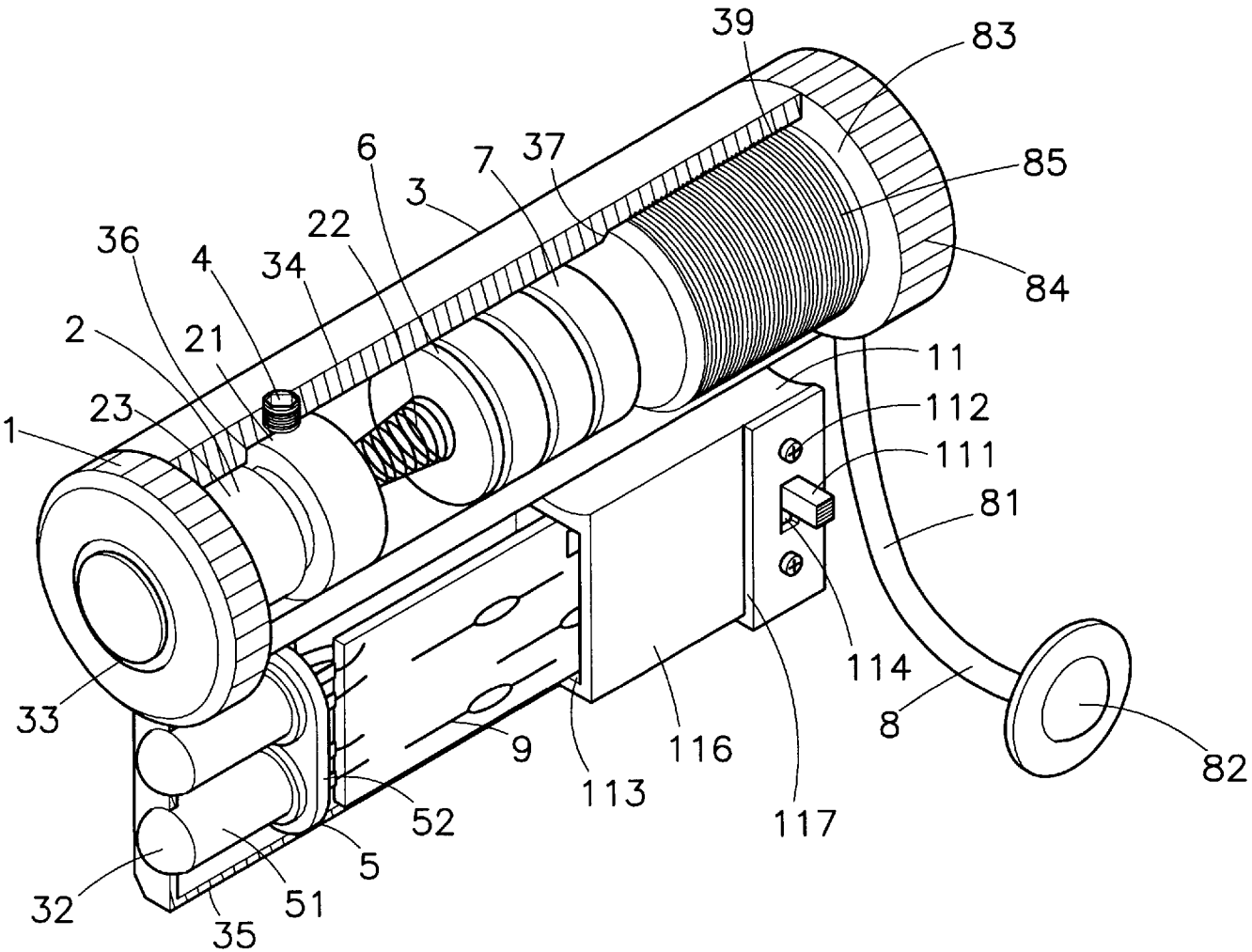
FIG. 1 is a perspective view of the present invention in part section of the maintube, and showing the internal components of the switching controller.
Figure 2:
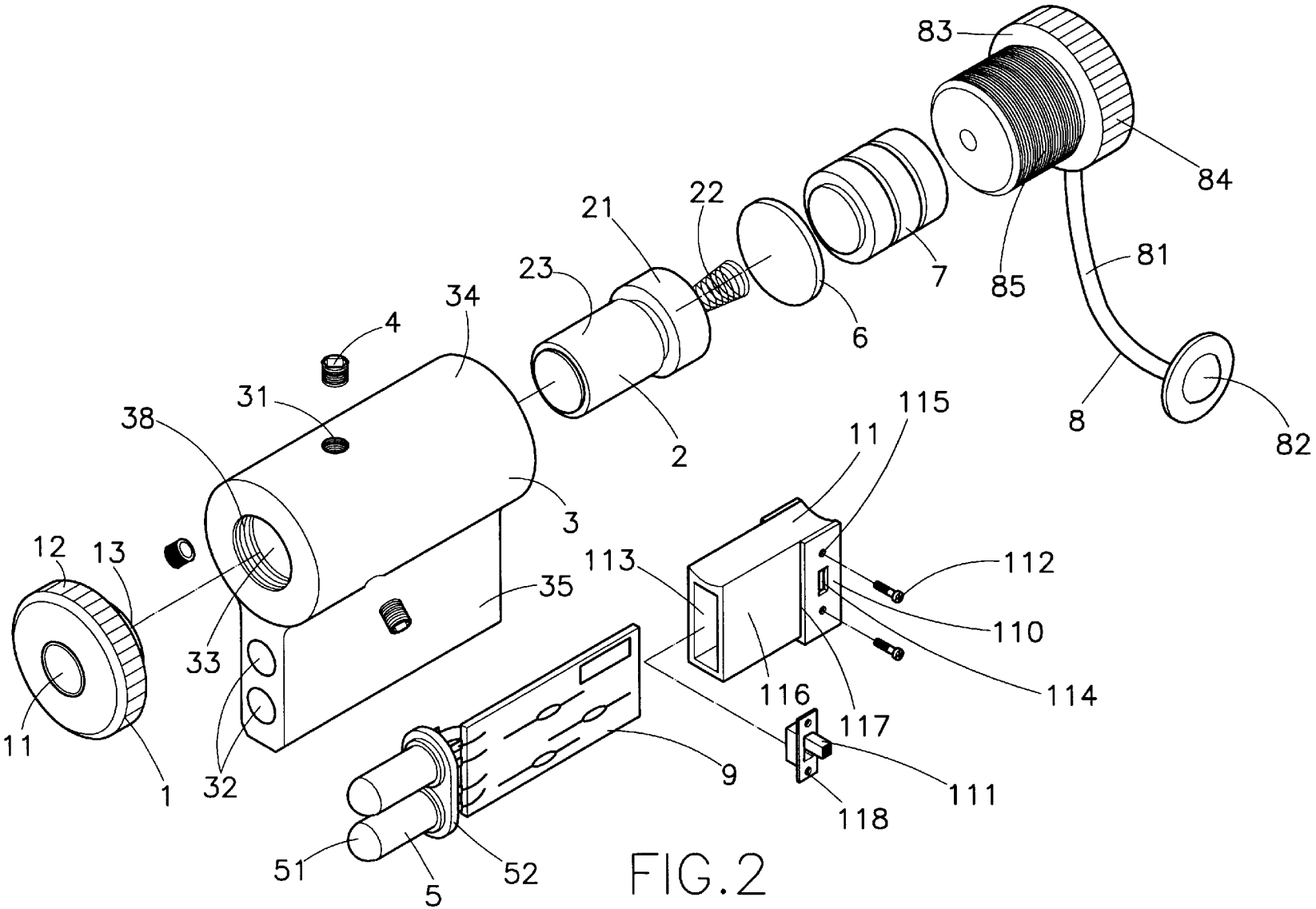
FIG. 2 is an exploded view of FIG. 1.

Referring now to FIGS. 1–2, there is shown a night laser sight comprising a front cover 1, a laser module 2, a maintube assembly 3, a plurality of (e.g., three) screws 4, a light-emitting diode CLED) device 5, a plurality of batteries 7, a switch device 8, and a switching controller 11.

The maintube assembly 3 comprises a first receiving space 34 and a second receiving space 35 atop (or below in an alternative implementation) the first receiving space 34 being integrated with the first receiving space 34. The first receiving space 34 is a hollow cylinder having a plurality of (e.g., three) holes 31 each spaced apart 120° provided on its circumference, and a beam outlet 33. The first receiving space 34 is tapered from back to front, i.e., the inner diameter of front portion is less than that of center portion, and the inner diameter of center portion is less than that of rear portion. A female screw thread 38 and a female screw thread 39 are provided in the inner tube of front portion and rear portion respective. The second receiving space 35 is a generally hollow parallelepiped body extended downwardly from the first receiving space 34 having a pair of beam outlets 32. The front cover 1 comprises a front beam outlet 11, a circumferential corrugated portion 12, and a rear raised cylindrical portion 13 having a male screw thread formed on the surface disposed correspondingly to the female screw thread 38 of the first receiving space 34.

The laser module 2 disposed in the rear of the front cover 1 comprises a hollow cylindrical back cover 21, a spring 22, and a laser body 23. The LED device 5 comprises one or more LEDs (two are shown) 51, a base 52, and a circuit board 9 in which the LEDs 51 are parallel secured to the base 52 which in turn attaches to the circuit board 9 through a plurality of pins for providing an electrical mating to the circuit board 9.

The switch device 8 comprises an extention cord 81, a film switch 82, a back cover 83, a circumferential corrugated portion 84 provided on the back cover 83, and a male screw thread 85 in which the extension cord 81 is attached between the back cover 84 and the switch 82. The switching controller 11 comprises a U-shaped member 110, an on/off switch 111, and a substantially hollow parallelepiped switch seat 116 having a rear portion secured to the U-shaped member 110, and a front opening 113. The switch 111 has a pair of second holes 118. The U-shaped member 110 comprises a pair of first holes 115 on a side, an opening 114 disposed between the first holes 115, and a pair of edges 117 formed in the junction of the switch seat 116 and the U-shaped member 110.

In assembly, firstly the back cover 21 is put and secured on the rear portion of the laser body 23. Then, the spring 22 is penetrated through the back cover 21 to be biased against the laser body 23. Put the laser module 2 into the back of the first receiving space 34 until the back cover 21 is stopped by a first edge 36 in the junction of the front portion and the center portion within the first receiving space 34. Screw three screws 4 into three corresponding holes 31 respectively for further securing the laser module 2 within the first receiving space 34. Put an insulated circular pad 6 in the back of the spring 22 for preventing conducting. This insulated pad 6 should be pulled out prior to operating. Put a plurality of batteries (e.g., preferably three serially connected 1.5 V batteries) 7 in the back of the insulated pad 6 for providing power required to stimulate the laser module 2. Put the switch 8 in the back of the batteries 7 for threadedly securing the male screw thread 85 to the female screw thread 39 of the first receiving space 34 until end of the male screw thread 85 is stopped by a second edge 37 in the junction of the center portion and the rear portion within the first receiving space 34. Insert the switch 111 into the opening 114 and then thread a pair of screws 112 through the first holes 115 and the second holes 118 to secure the switch 111 on the switching controller 11. Put the circuit board 9 into the hollow space of the switching controller 11 for being in electrical contact with the switch 111. Put the LED device 5 into the second receiving space 35 in order to fit the heads of the LEDs 51 into the beam outlets 32 until the edge 117 is urged against the back of the second receiving space 35.

When the switch 82 is turned on, a user can choose to turn on the laser module 2 and the LED device 5 simultaneously, or turn on the laser module 2 and turn off the LED device 5. As a result, a pair of laser beams are emitted from the beam outlets 32 and a laser beam is emitted from the beam outlet 33 respectively for projecting on the aimed target.

Figure 3:
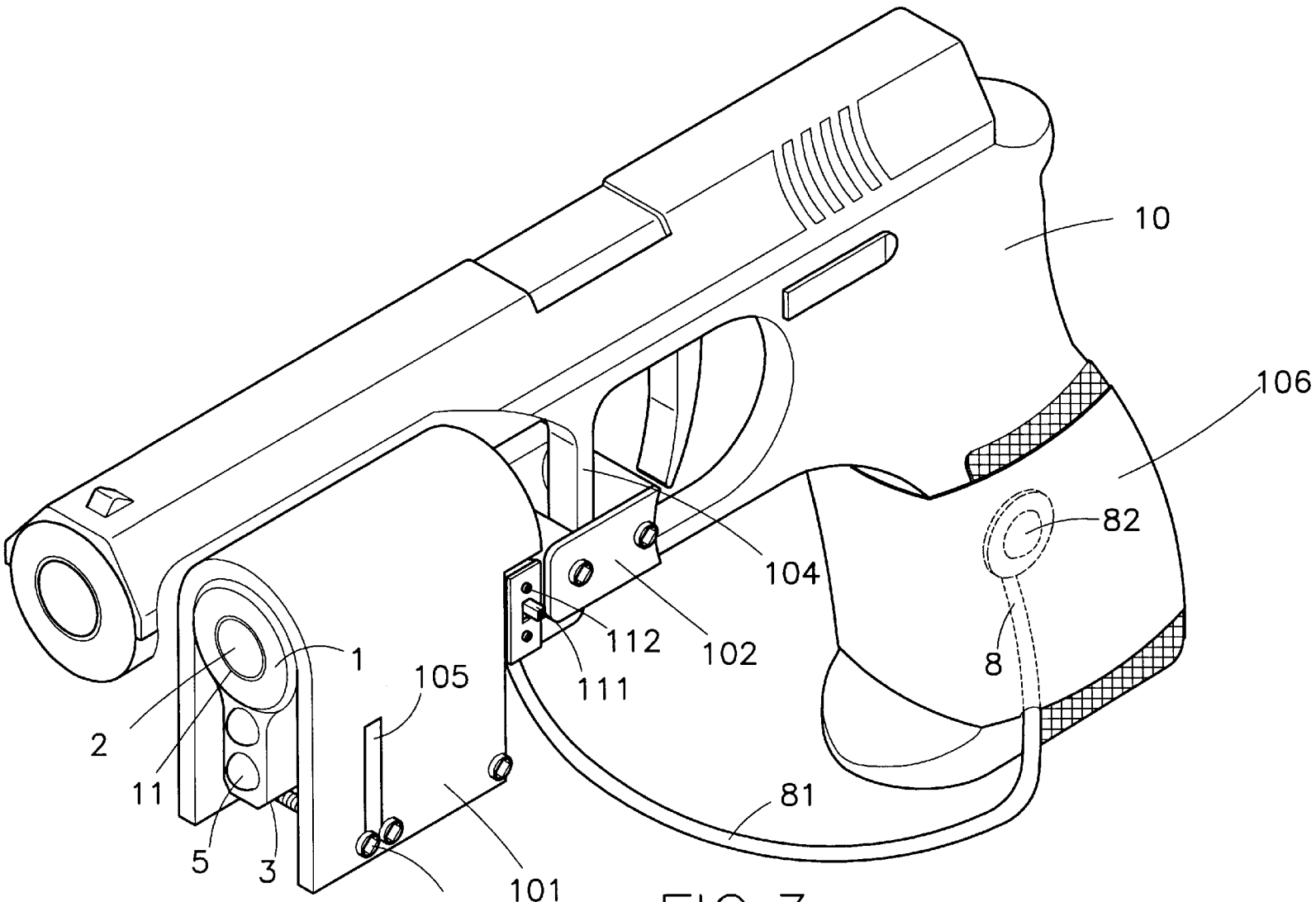
FIG. 3 is a preferred embodiment of the present invention mounted in a pistol.

In FIG. 3, the night laser sight of the invention mounted on a pistol 10, is received in a n-shaped cover 101. The n-shaped cover 101 comprises a pair of grooves 105 each extended a predetermined distance upwardly from the bottom of a side. Such that a plurality of bolts 103 can pass through the grooves 105 to fasten the night laser sight within the n-shaped cover 101. A fastener 102, provided in the back of the n-shaped cover 101, is secured to a trigger guard 104 of the pistol 10 by means of a number of bolts. The switch 82 is attached to a butt of the pistol 10 and secured thereon by an elastic band 106.

While the invention herein disclosed has been described by means of specific embodiments, numerous modifications and variations could be made thereto by those skilled in the art without departing from the scope of the invention set form in the claims.

What is claimed is:

1. A sight system comprising:

(a) a maintube assembly including adjacent first and second portions, said first portion defining a first receiving space and a first beam outlet in open communication therewith, said second portion defining a second receiving space and a plurality of second beam outlets in open communication therewith;

(b) a front cover secured to a front of said first portion, said front cover defining a third beam outlet communicating with said first beam outlet;

(c) a laser module disposed in said first receiving space;

(d) light-emitting diode means disposed within said second receiving space;

(e) a plurality of batteries disposed within said first receiving space for powering said laser module and said laser-emitting diode means;

(f) switch means coupled to said batteries for actuating said laser module and said laser-emitting diode means;

(g) a switching controller disposed at least partially within said second receiving space;

whereby said laser module and said laser-emitting diode means are selectively operable to respectively emit light through said first and second beam outlets.

2. The sight system as recited in claim 1 wherein said first portion has formed therein a plurality of angularly spaced holes, said sight system further comprising a plurality of screws each threadedly engaging one said hole for securing said laser module within said first receiving space.

3. The sight system as recited in claim 1 wherein said switch means includes a film switch device.

4. The sight system as recited in claim 1 comprising three said batteries coupled in series, each said battery providing approximately 1.5 V.

5. The sight system as recited in claim 1 further comprising an insulated pad removably disposed between said batteries and said laser module for disabling operation of said laser module.

6. The sight system as recited in claim 1 further comprising a cover, said cover having substantially an inverted u-shaped contour, said cover being formed with a pair of groove slots extending upward from a bottom side thereof, and a plurality of bolts each engaging said groove slots for securing to said cover said first and second portions.

7. The sight system as recited in claim 6 further comprising a fastener coupled to at least one of said first and second portions, said fastener being adapted for coupling to a trigger guard of a pistol.

8. The sight system as recited in claim 1 wherein said first portion is disposed atop said second portion.

9. The sight system as recited in claim 1 wherein said switch means includes a back cover, a switch device, and an extension cord extending therebetween.

10. The sight system as recited in claim 1 wherein said light-emitting diode means includes:

(a) a circuit board;

(b) a base electrically coupled to said circuit board; and, (c) at least one light-emitting diode device secured to said base to engage at least one said second beam outlet.

11. The sight system as recited in claim 9 wherein said back cover has formed thereon a circumferential corrugated portion.

12. The sight system as recited in claim 1 wherein said front cover has formed thereon a circumferential corrugated portion.

13. The sight system as recited in claim 1 wherein said switching controller includes:

(a) a U-shaped member having a pair of opposed side walls, at least a first of said side walls having formed therein a pair of spaced first holes and a center opening disposed therebetween;

(b) a substantially hollow parallelepiped switch seat having a rear portion received in said U-shaped member, said switch seat having a front opening; and, (c) a switching device coupled to said first side wall having a pair of second holes formed therethrough.

14. The sight system as recited in claim 13 wherein said sidewalls of said U-shaped member form edge portions protruding from said switch seat.

15. The sight system as recited in claim 13 wherein said switching device engages said center opening of said first side wall.

16. The sight system as recited in claim 15 wherein said second holes of said switching device are aligned with said first holes of said first side wall, said switching controller further including a pair of screws each engaging said aligned first and second holes.

17. The sight system as recited in claim 16 wherein said light-emitting diode means includes:

(a) a circuit board;

(b) a base electrically coupled to said circuit board; and, (c) at least one light-emitting diode device secured to said base to engage at least one said second beam outlet.

18. The sight system as recited in claim 17 wherein said circuit board is received at least partially within said switch seat coupled to said switching device.

19. The sight system as recited in claim 18 wherein said edge portions of said switching controller engage said second portion for capturing said light-emitting diode means in said second receiving space.

* * * * *